United States Patent [19]

Fishburne

[11] Patent Number: 4,572,065

[45] Date of Patent: Feb. 25, 1986

[54] METHOD AND APPARATUS FOR PACKING TOBACCO

[76] Inventor: Francis B. Fishburne, 174 Weston Rd., Arden, N.C. 28704

[21] Appl. No.: 621,763

[22] Filed: Jun. 18, 1984

[51] Int. Cl.[4] ..... B30B 1/32; B30B 15/30

[52] U.S. Cl. ..... 100/35; 53/436; 53/510; 53/527; 100/90; 100/92; 100/269 R; 100/295; 141/80

[58] Field of Search ..... 100/215, 295, 70 R, 100/269 R, 35, 90, 92; 141/73, 80; 53/436, 510, 527

[56] References Cited

U.S. PATENT DOCUMENTS

| | | | |
|---|---|---|---|
| 2,488,395 | 11/1949 | Goldberg | 100/90 X |
| 2,607,435 | 8/1952 | Dohse | 100/90 |
| 2,954,730 | 10/1960 | Moser | 100/90 X |
| 3,377,945 | 4/1968 | Davis | 100/90 |
| 3,583,312 | 6/1971 | Van Doorn | 100/90 |
| 3,895,572 | 7/1975 | Nitschke | 100/35 |
| 3,968,619 | 7/1976 | Fishburne | 100/249 X |
| 4,457,125 | 7/1984 | Fishburne | 141/80 X |

FOREIGN PATENT DOCUMENTS

| | | | |
|---|---|---|---|
| 1269489 | 5/1968 | Fed. Rep. of Germany | 100/90 |

*Primary Examiner*—Billy J. Wilhite

*Attorney, Agent, or Firm*—Roylance, Abrams, Berdo & Goodman

[57] ABSTRACT

Method and apparatus which reduces the charger height and the total cycle time when packing leaf or stripped tobacco by the two fill approach. When the first fill is completed, an air pressure differential is established across the tobacco in the charger from top to bottom, the pressure differential compacting the tobacco to make room for the second fill. The second fill is then supplied and the two fills are compacted into the compression chamber by the packer ram. The air pressure differential is established by providing a volume of air under pressure between the press head of the ram and the tobacco of the first fill and withdrawing air from the bottom of the charger, and withdrawal of air is continued during the second fill and the compression stroke of the ram.

9 Claims, 12 Drawing Figures

METHOD AND APPARATUS FOR PACKING TOBACCO

This invention relates to the packing of tobacco and particularly to packing leaf and stripped tobacco into cases or bales.

BACKGROUND OF THE INVENTION

Vertically operating hydraulic packers have long been used in tobacco redrying factories to pack the redried tobacco into cases or bales. In usual form, such packers comprise a compression chamber which communicates at its top with an elongated hollow upright charger, a vertically acting press ram having a press head being aligned above the charger so that the ram can be operated to force the press head downwardly through the charger to or into the compression chamber. With the press head raised, the loose tobacco to be packed is supplied into the top of the charger below the press head, with supply continuing until the charger contains a predetermined quantity of loose uncompacted tobacco, and the ram is then operated to force the press head downwardly through the charger and compress the entire quantity of tobacco into the compression chamber. While such packers have achieved great success, problems have arisen because of continually increasing production capabilities of the redrying factories. Tobacco redryers are operated continuously and, in usual cases, one packer must handle the entire output of the redryer and must do so without delays or interruptions, else the entire redrying line must be shut down. Accordingly, as production rates at the redryer factories increased, the rate of fill of tobacco into the charger of the packer increased, and it has been necessary to make the chargers taller and taller until the height of the chargers is now as much as twenty four feet or more. Since the press ram necessarily includes a rectilinear hydraulic motor of the piston and cylinder type, with the cylinder extending vertically above the charger for a distance determined by the length of the stroke of the press head through the charger, the total height of the packer has become quite great. Thus, in a typical packer having a charger seventeen feet tall, total height of the packer may be sixty six feet. Such heights frequently pose severe problems. In some cases, it is necessary that the packer extend upwardly through the roof of the building in which the redryer is housed. In the case of multistory buildings, there is frequently no suitable location for a very tall packer. Increasing the height of the packer increases he cost, both of the packer and of the conveyor system which supplies tobacco to the charger, and also makes the conveyor systems unduly complicated. Increasing the charger height also exascerbates another problem encountered with such packers. A rapid down stroke of the ram is required and, during downward movement of the press head through the charger, air is trapped in the column of tobacco being compressed and the air is compressed as the tobacco is compressed. Because of presence of the compressed air in the compressed cake of tobacco, the press head cannot be returned immediately at the end of its down stroke, else the compressed cake of tobacco will increase in height as soon as the press head moves upwardly. To counter this problem, the prior art approach has been to hold the press head at the bottom of its stroke for a period on the order of fifteen seconds, this being time enough for the compressed air in the cake to escape so that the cake "takes a set". Thus, the trapped air increases the cycle time of the packer by about 15 seconds, a time which constitutes a significant portion of the total cycle.

Various appraches have been adopted in the prior art to reduce packer height. A "two fill" operation has been used, with the charger being shorter than required for the total amount of tobacco for one case or bale, and the press head has been forced down to compress the tobacco of the first fill into the compression chamber and then raised to allow the second fill, then forced down again through a final compression stroke. However, the two fill approach has had the disadvantage of causing a line of demarcation in the final compressed cake, the line of demarcation resulting from the use of the two successive full compression strokes. Being observable to prospective buyers of the packed tobacco, such a line of demarcation is objectionable. Another approach has been to tamp the tobacco in the charger before pressing, usually with a tamping device having downwardly projection "fingers". Though such tamping operations make room for additional tobacco, thus allowing shortening of the charger, they have the disadvantage of causing degradation of the tobacco, particularly the breaking down of the large pieces of lamina into small fragments. There has accordingly been a continuing need for improvement.

SUMMARY OF THE INVENTION

Method and apparatus embodiments of the invention achieve both a reduction in charger height, and thus in the total packer height, and a reduction in packer cycle time, using the two fill approach with improvements which eliminate lines of demarcation as well as degradation of the tobacco. When the first fill has been completed, the column of loose tobacco of the first fill is compacted by establishing an air pressure differential across the tobacco from top to bottom, this being accomplished by establishing a volume of air under positive pressure in the charger between the first fill of loose tobacco and the raised press head and withdrawing air from the charger at or near the bottom to establish a negative pressure at the bottom of the column of loose tobacco. Under the action of the differential pressure, the pieces of tobacco at the upper surface of the column of loose tobacco are substantially instantaneously pressed together, forming in effect a seal at the upper surface of the column of loose tobacco, so that the continuing action of the differential pressure is to compact the column of loose tobacco downwardly until there is room in the charger for the second fill of loose tobacco. At this stage, th positive air pressure above the now preliminarily compressed tobacco of the first fill is dissipated, withdrawal of air from the bottom of the charger is continued, and the second fill of loose tobacco is supplied to the charger. Upon completion of the second fill, the ram is operated to force the press head downwardly to compress all of the tobacco into the compression chamber while the withdrawal of air from the bottom of the charger is continued throughout the compression stroke, air withdrawal then being terminated. The resulting compressed cake exhibits no signs of degradation of the tobacco and no line of demarcation between the tobacco of the first and second fills.

According to one embodiment, the volume of air under positive pressure is established above the tobacco of the first fill by supplying air from a high power blower to the charger via an opening or openings in the charger wall below the press head but above the upper surface of the tobacco, the air advantageously being drawn in part from a location where ambient air has a temperature approximating that of the tobacco from the redryer. The blower also withdraws air from the bottom of the charger, simultaneously with establishment of the volume of air under positive pressure above the tobacco. According to a second and particularly advantageous embodiment, the volume of air under positive pressure is established by rapid downward movement of the press head to compress the air within the charger in that space between the top of the first fill of loose tobacco and the press head in its initial position in the charger, the rapid downward movement of the press head advantageously resulting from gravitational free fall of the combination of the press head and its attached piston rod.

Apparatus according to the invention differs from prior art packers in several respects. First, the press head is of such size and shape that, when the press head is positioned in a predetermined location within the top portion of the charger, there is but a very small clearance, typically 1/32 inch, between the press head and the charged wall. Next, the charger has precisely the same rectangular internal cross section throughout its length, so that the very small clearance persists through the length of the charger. Thus, the charger cannot be telescopic. Advantageously, the loose tobacco from the redryer is supplied to the charger through an opening in one side of the charger in a location spaced substantially below the top of the charger, and a power operated closure is provided to seal that opening after a fill of tobacco has been made. So that the press head will be free for movement upwardly after a compression stroke, at least one opening is provided in the charger wall in a location immediately above the compression chamber and power operated closure means is provided to selectively open and close that opening. Thus, that closure means is opened just as upward travel of the press head commences and air is admitted to the charger below the press head but above the compression chamber to prevent upward travel of the press head being resisted by a negative air pressure and to prevent the compressed cake of tobacco from being suddenly subjected to negative pressure.

IDENTIFICATION OF THE DRAWINGS

DETAILED DESCRIPTION OF THE INVENTION

Apparatus of FIGS. 1–4C

Figures 1, 3:
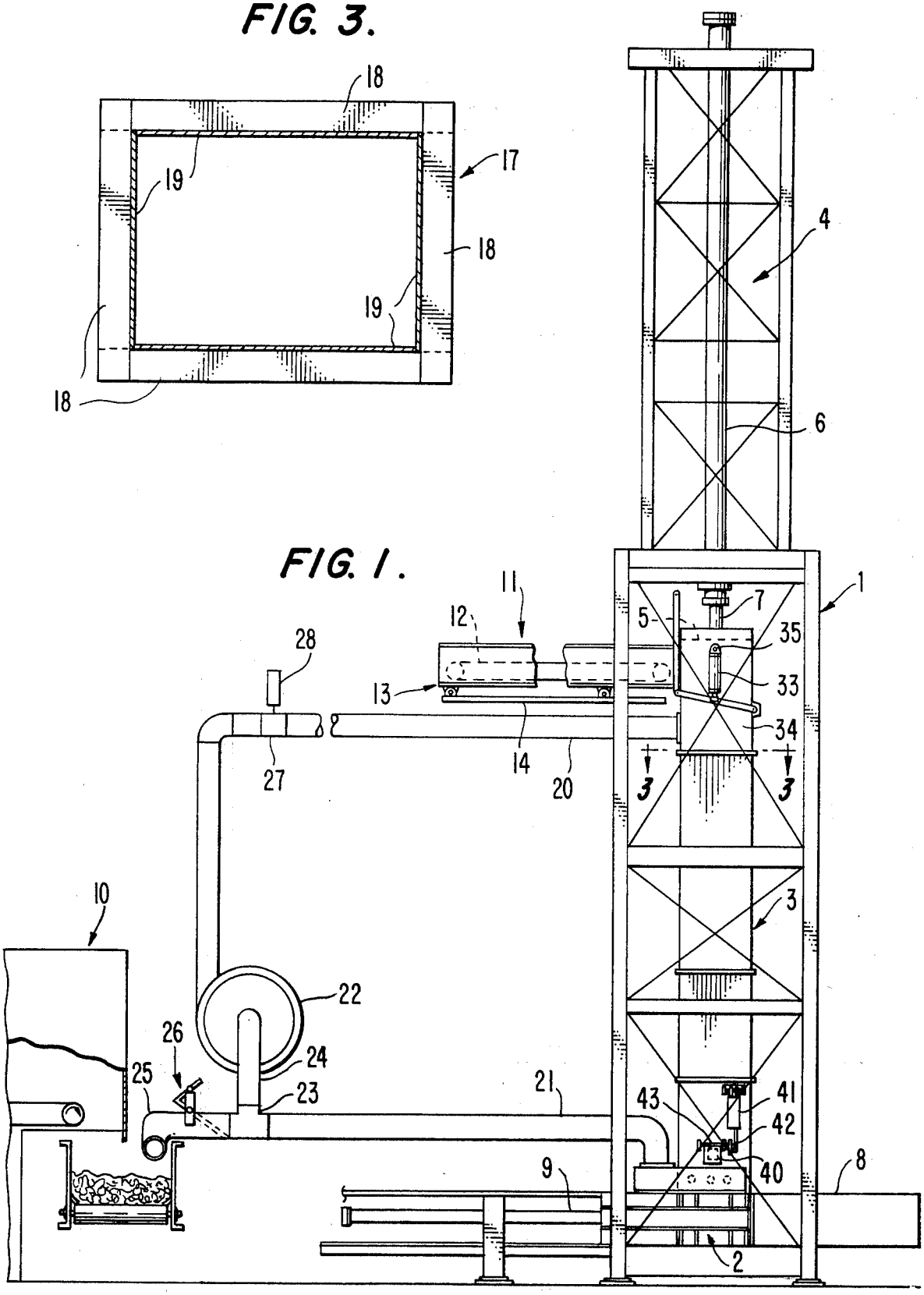
FIG. 1 is a semidiagrammatic side elevational view of apparatus for packing redried leaf or strip tobacco into the form of enclosed bales according to one method and apparatus embodiment of the invention.
FIG. 3 is a cross-sectional view taken generally on line 3—3, FIG. 1.
Figure 2:
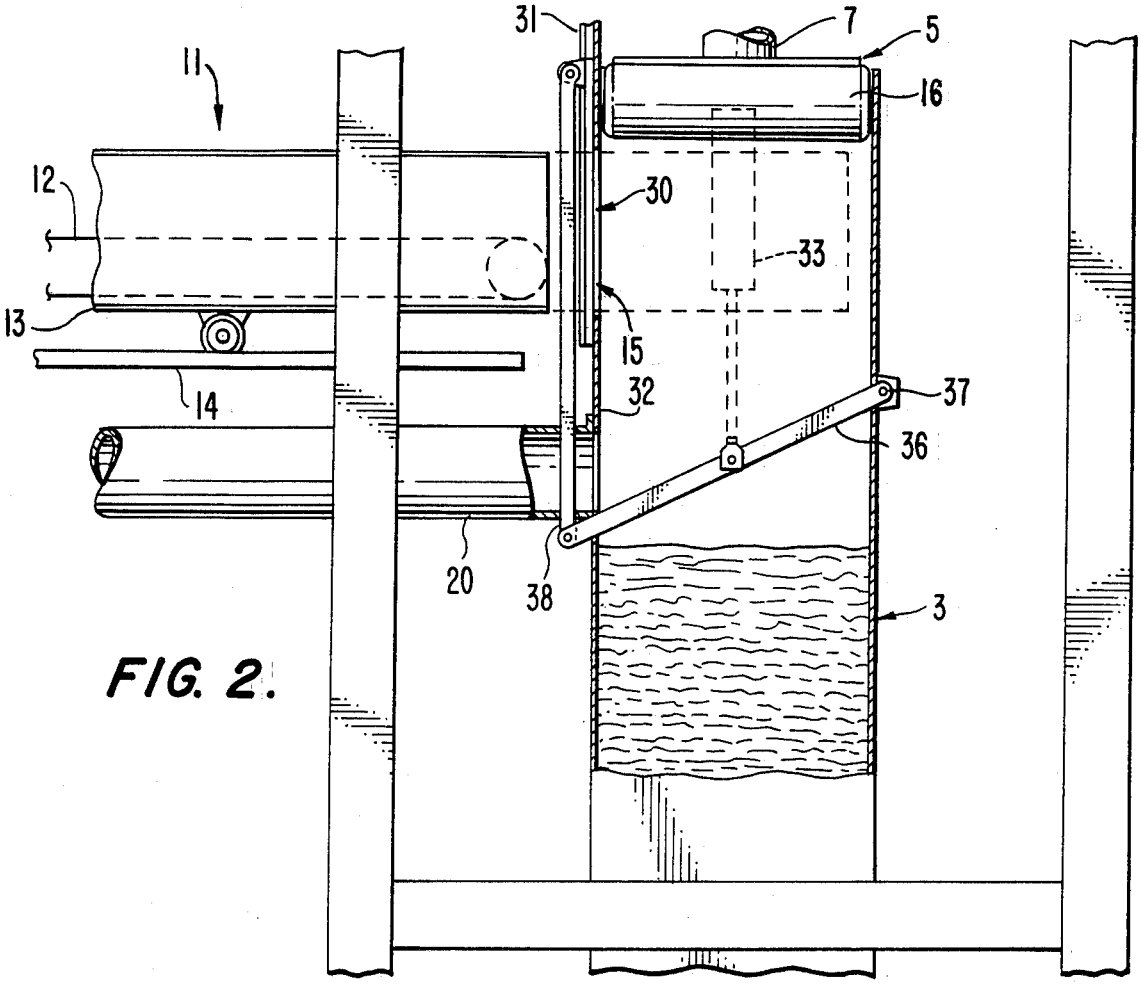
FIG. 2 is a fragmentary view, partly in side elevation and partly in vertical cross section, enlarged with respect to FIG. 1, showing parts of the apparatus in positions preparatory to establishment of a volume of air under positive pressure above a first fill of tobacco in the charger.

FIGS. 1–3 illustrate an apparatus embodiment of the invention for producing enclosed bales of leaf or strip tobacco generally in accordance with my U.S. Pat. No. 3,968,619. The apparatus comprises an upright packer frame 1 supporting a compression chamber 2, an upright charger 3 which opens at its bottom end into the compression chamber, and a ram 4 comprising a press head 5, a power cylinder 6 and a piston rod 7 to which head 5 is rigidly secured. Chamber 2 and charger 3 are of rectangular transvers cross section, with the rectangle of the cross section elongated from left to right as viewed in FIG. 1. At one end, the compression chamber is provided with a movable door such that, when the door is elevated to open position, that end of the chamber opens into a sleeve 8 through which a compressed cake of tobacco formed in the compression chamber is extruded into a suitable container as described in my U.S. Pat. No. 3,968,619. The opposite end of the compression chamber is formed by an ejecting ram 9 which can be operated to force the compressed cake of tobacco into the sleeve.

Loose tobacco from redryer 10 is delivered by conventional conveyors (not shown) to a charger feed conveyor, indicated generally at ll, comprising an endless conveyor belt 12 carried by a wheeled carriage 13 supported on rails 14, power means (not shown) being provided to drive the conveyor belt and to move the carriage in reciprocatory fashion between its home position, seen in solid lines in FIG. 2, and a position, shown in broken lines in FIG. 2, in which the delivery end of the conveyor belt is near the side of the charger opposite the home position of the conveyor, such movement being possible because the wall of the charger nearer the conveyor is provided with an opening 15, FIG. 2. With loose tobacco supplied continuously to conveyor 11 and with belt 12 operating, such reciprocatory movement causes the feed conveyor to feed the tobacco substantially uniformly across the cross section of the charger, with the tobacco falling to form an uncompacted mass which progressively fills the compression chamber and most of the charger.

As will be best understood from FIG. 2, presshead 5 is a heavy metal structure which has a rectangular periphery of smaller dimensions than but of the same shape and concentric with the charger wall. Press head 5 is provided with rub strips 16 of hardwood, there being four such strips each secured to a different side edge of the press head. The dimensions of the press head and rub strips are such that, with the press head positioned within the charger, the rounded outer edges of rub strips 16 are very close to the respective flat walls of the charger, the space between each rub strip and adjacent charger wall advantageously not exceeding 1/32 inch.

Charger 3 is so constructed that it presents the same internal cross-sectional dimensions throughout its length. Since the piston rod of the ram keeps the press head essentially concentric with the inner surface of the charger, the very small spacing between the periphery of the press head and the walls of the charger is essentially constant throughout each stroke of the press head. Advantageously, the charger comprises a plurality of rectangular cages 17 each composed of four heavy metal bars 18, FIG. 3, overlapped and welded at their ends. The cages are supported vertically and in horizontal lignment on a work table (not shown) and the side wall plates 19 placed against the inner edges of bars 18 and welded to the respective bars, with external welds then being made along the mating edges of the plates which define the corners of the charger. Made in this fashion, the cages are truly rectangular and free from warpage during welding since the ends of bars 18 are overlapped, and the inner faces of the plates remain true and completely flat.

In a location immediately below opening 15, the charger is provided with at least one air inlet opening communicating with the delivery end of an air supply duct 20. In a location immediately above compression chamber 2, the charger is provided with at least one air outlet opening communicating with an air withdrawal duct 21. Duct 20 communicates with the exhaust of a conventional high volume rate blower 22. Duct 21 communicates with the inlet of the blower via T-connection 23 and duct 24. Also communicating with the inlet of the blower via connection 23 and duct 24 is a supplemental air supply duct 25 arranged to communicate with a space, such as that adjacent the conveyor which receives tobacco from the redryer 10, where the ambient air temperature approximates that of the tobacco delivered by the redryer. A conventional plate valve 26, spring biased to close, is provided in duct 25 and opens automatically and progressively to admit air via duct 25 when, as a result of progressive compaction of tobacco in the charger, less air is available via duct 21. A quick-opening shut off valve 27, actuated by a pressure fluid operated piston and cylinder type power device 28, is installed in duct 20.

Opening 15 can be opened and closed by a vertically movable flat closure member 30, FIG. 2, slidably engaged in two opposed guidways 31 each secured to one edge of the charger wall plate 32 which defines opening 15. Closure member 30 is actuated by a pressure fluid operated piston and cylinder motor 33 having the blind end of its cylinder mounted on charger wall plate 34 to swing about the axis of a pivot pin 35. The free end of the piston rod of motor 33 is pivotally connected to a lever 36, at a point intermediate the ends of the lever, one end of lever 36 being mounted on the wall of the charger opposite wall plate 32 so as to swing about the horizontal axis of a pivot pin 37. The opposite end of lever 36 is pivotally connected to the lower end of a link 38 which extends upwardly on one side of the path of travel of conveyor 11 and has its upper end pivotally secured to the top of closure member 30. Motor 33 is double acting. Activation of the motor to extend its piston rods swings lever 36 upwardly, sliding member 30 to its uppermost position and freeing opening 15 for passage of the conveyor back and forth across the interior of the charger. Retraction of the piston rod of motor 33, at a time when conveyor 11 has returned to its home position, swings lever 36 downwardly, sliding member 30 downwardly to its closed position.

In a location at the bottom of the charger, advantageously a location matching the lowermost position of the press head at the end of its downward stroke, at least one wall of the charger has an air inlet opening which is normally closed by a pivoted closure plate 40. Plate 40 can be pivoted away from the charger wall to open the air inlet opening by retraction of the piston rod of a double acting pressure fluid operated cylinder and piston type motor 41, the blind end of the cylinder of motor 41 being pivotally mounted on the charger wall, the free end of the piston rod being pivotally connected to a crank arm 42 fixed to a pivot shaft 43 which carries plate 40.

Figures 4, 4A, 4B, 4C:
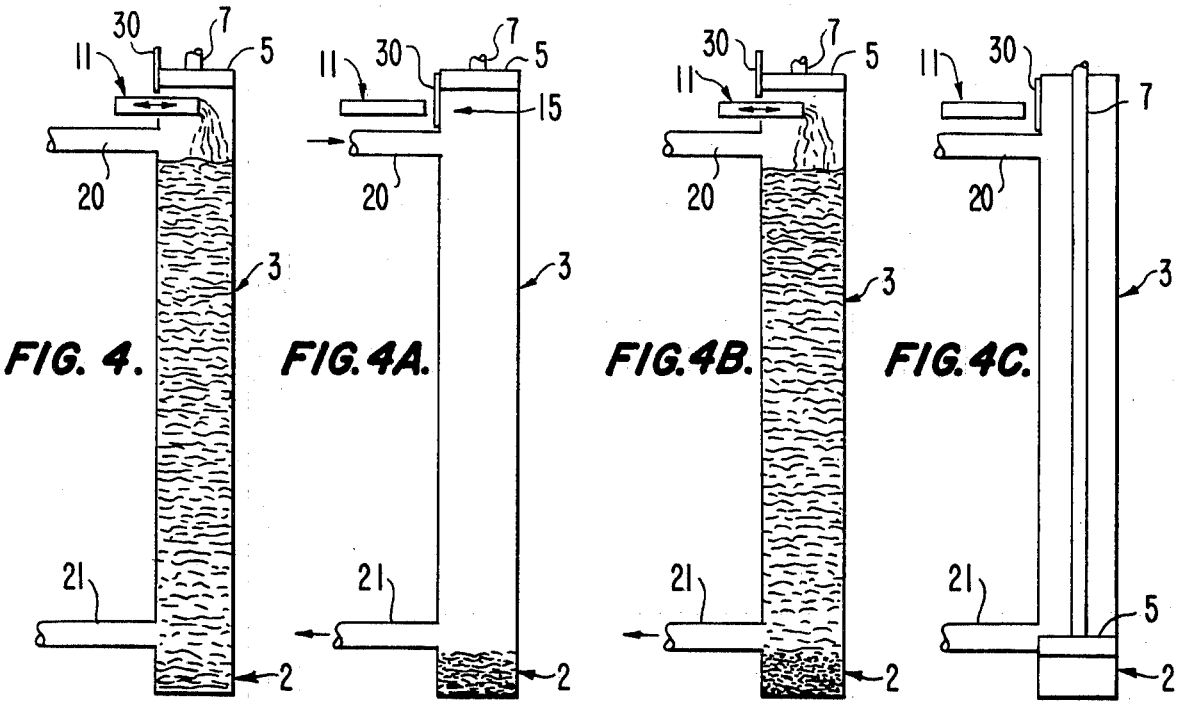
FIGS. 4–4C are sequence diagrams illustrating operation of the apparatus of FIGS. 1–3.

With press head 5 in its uppermost position, within the upper end portion of the charger and above opening 15, and with blower 22 inactive, conveyor 11 is operated to supply a first predetermined quantity of tobacco, supplied to conveyor 11 from the redryer, through opening 15 and into the charger. With conveyor 11 reciprocating across the charger continually during supply of the tobacco, the tobacco falls through the charger and builds up as a loose uncompacted mass filling the compression chamber and a substantial portion of the charger. When supply of the predetermined quantity of tobacco has been completed, with the upper end of the column of tobacco now being located just below the air inlet opening to which duct 20 is connected, as shown in FIG. 4, conveyor 11 is returned to its home position and motor 33 is activated to retract its piston rod, moving member 30 downwardly past the adjacent end of the conveyor to close opening 15.

Blower 22 having been activated, valve 27 is opened so that the full output of the blower is delivered via duct 20 into that space within the charger between press head 5 and the upper end of the column of tobacco, the blower at the same time withdrawing air from the bottom of the charger via duct 21. Air delivered from the blower to the space within the charger above the column of loose tobacco immediately establishes in that space a positive air pressure while withdrawal of air from the bottom of the charger by the blower establishes a negative pressure at the bottom of the mass of tobacco, so that an air pressure differential exists between the top and bottom of the mass of tobacco. With the tobacco at the upper surface of the mass of tobacco having been compacted immediately by the air pressure differential and so resisting substantial downward passage of air, the continuing effect of the air pressure differential is to push downwardly upon the total mass of tobacco. Loss of air via the very small space between the press head and charger wall, and via any small egress at closure member 30, is small in comparison to the high volume delivery rate of the blower. Such losses can be tolerated since, for typical charger cross-sectional areas, a positive air pressure of about three pounds per square inch above the tobacco will apply a total downward force of about 3,500 pounds to the mass of tobacco. The air pressure differential accordingly acts to compact the mass of tobacco progressively, as illustrated in FIG. 4A, with the extent of compaction depending upon the time period for which the air pressure differential persists and the magnitude of the differential.

When the first fill of tobacco has thus been adequately compacted to make room in the charger for the second fill, valve 27 is closed and blower 22 left in operation, continuing to withdraw air from the bottom of the charger. Continued operation of the blower after closing valve 27 is made possible by making the length and volume of that portion of duct 20 between the blower and valve 27 adequate to serve as an accumulator or, if desired, to employ a separate accumulator (not shown). Motor 30 is now operated to move closure member 30 to its open position, clearing opening 15 so that feed conveyor 11 can again be operated. A second predetermined quantity of tobacco is now supplied to the charger by conveyor 11, the total of the first and second quantities being equal to the amount of tobacco required for the finished bale. Blower 22 remains in operation throughout the second fill. The second fill having been completed, the charger is again substantially full of tobacco, as seen in FIG. 4B, the first quantity A being preliminarily compacted, the second quantity B being supported as a loose, uncompacted mass by the first quantity. Pressure fluid is then supplied to cylinder 6 to force the press head 5 downwardly through the charger, as shown in FIG. 4C, until the press head is in position to serve as the upper wall of the compression chamber, so that the combined first and second quantities of tobacco are in the form of a homogeneous compressed cake which can be forced outwardly through sleeve 8. Operation of blower 22 to withdraw air from the bottom of the charger is continued throughout the final pressing stroke and terminated when the press head reaches its lowermost position.

Upon completion of the press stroke, motor 41 is activated to swing closure plate 40 away from the charger wall to open the air inlet opening which plate 40 has maintained effectively closed throughout the operations just described. Pressure fluid is applied to cylinder 6 to raise press head 5 to its initial position, seen in FIGS. 1 and 2.

Compressed cakes of tobacco produced as just described are uniform and exhibit no line of demarcation between the compressed tobacco of the two fills.

Figure 5:
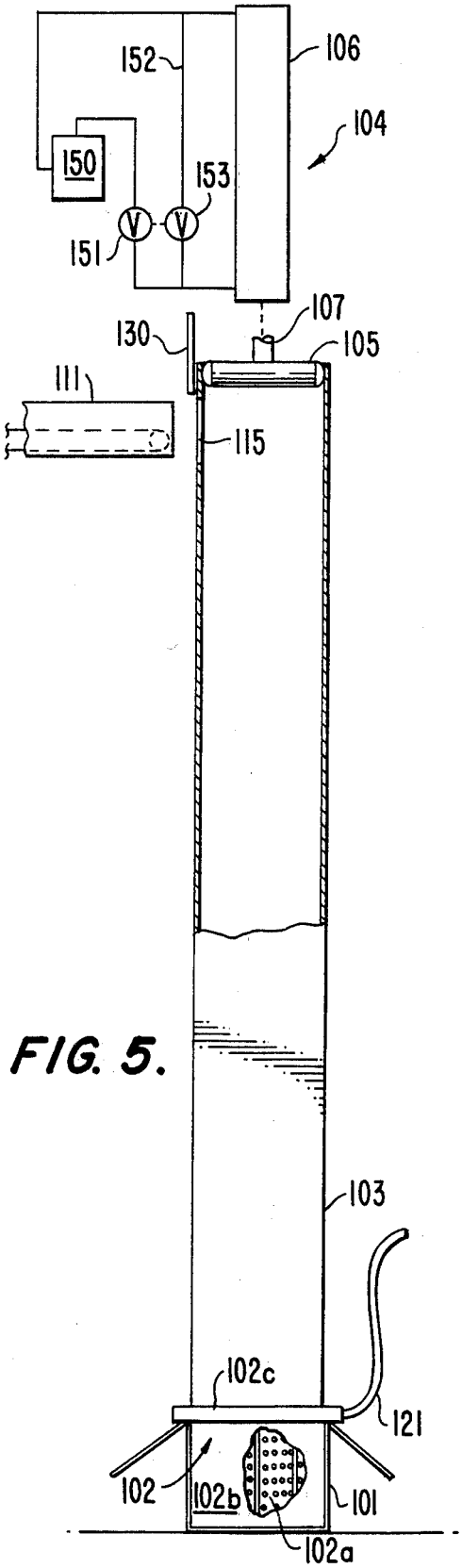
FIG. 5 is a diagrammatic side elevational view illustrating another apparatus embodiment of the invention.
Figure 6:
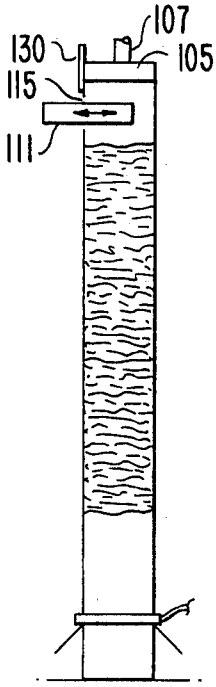
FIGS. 6–6C are sequence diagrams illustrating operation of the apparatus of FIG. 5 according to the method.
Figure 6A:
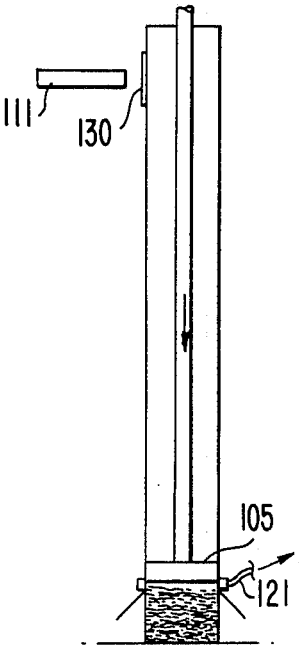
Figure 6B:
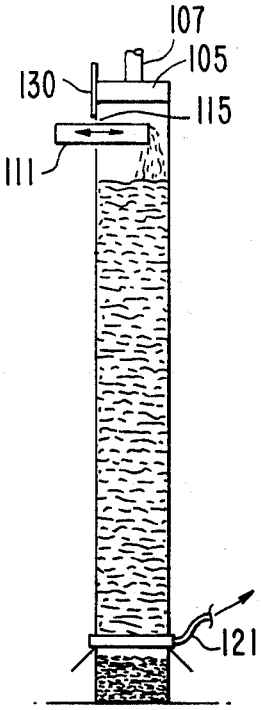
Figure 6C:
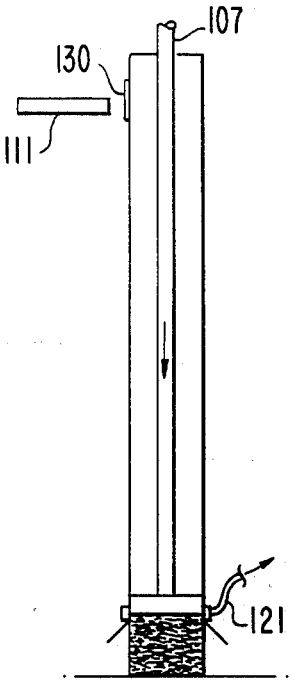

The Embodiment of FIGS. 5–6C

In this embodiment, the air pressure differential for compacting the loose mass of tobacco of the first fill is established by providing air escape openings at the lower end of the charger and moving the press head downwardly through the charger very rapidly from an initial position spaced well above the top of the mass of tobacco, the opening through which the tobacco has been supplied being closed before rapid downward movement of the press head starts. Recognizing that the combined weight of the press head and its piston rod is on the order of 5000–7000 pounds, rapid movement of the press head can be accomplished simply by allowing the press head and its piston rod to fall freely under the influence of gravity.

In this embodiment, the packer comprises a compression chamber 102, FIG. 5, in the form of an air release sleeve capable of being inserted downwardly into a case 101 and withdrawn upwardly therefrom. As disclosed in detail in my copending application Ser. No. 487,732, filed April 22, 1983, now U.S. Pat. No. 4,457,125, such air release sleeves are of double wall construction, the inner wall 102*a* being perforated and the outer wall 102*b* being solid. At its top, the sleeve is equipped with a duct 102*c* which communicates with the space between walls 102*a* and 102*b* and thus with the perforations in the inner wall. Duct 102*c* also communicates with a conduit 121 leading to the intake of a suction blower (not shown). At its top, the air release sleeve is secured to charger 103 so that the compressions in the inner wall of the air release sleeve communicate with the charger. As disclosed in the aforementioned copending application, the combination of charger and air release sleeve is mounted for vertical movement so that the sleeve can be inserted downwardly into case 101 preparatory to packing tobacco into the case and can be withdrawn upwardly from the case after packing has been completed.

Charger 103 is constructed in the same manner as earlier described for charger 3 of the embodiment of FIGS. 1–4C. Thus, charger 103 has transverse cross-sectional dimensions which are constant throughout the length of the charger. Feed conveyor 111 is mounted near the top of the charger and can be reciprocated horizontally through an opening 115 in the charger wall. Opening 115 can be closed by a vertically movable closure member 130 which is mounted and operated as described with reference to FIGS. 1 and 2.

Ram 104 comprises press head 105, power cylinder 106 and piston rod 107. Cylinder 106 is hydraulically operated by pressure fluid delivered to the blind end of the cylinder by a pump unit 150, the fluid displayed by powered travel of the piston being returned to the pump unit via valve 151 which is open when the press head is driven downwardly by pressure fluid from the pump unit. However, the pump unit can be short-circuited via duct 152 and valve 153. Valves 151 and 153 are mechanically interconnected so that, when valve 151 is open, valve 153 is closed and when valve 153 is open valve 151 is closed. Accordingly, the combination of press head 105 and piston rod 107 can be released for free fall through the charger simply by opening valve 153 so that the fluid below the piston of the ram simply flows to the space above the piston as the free flow occurs.

Conveyor 111 is operated to supply a predetermined first quantity of tobacco to the charger while the press head 105 is in its uppermost position, as seen in FIGS. 5 and 6. Thus, the compression chamber 102 and charger 103 are filled with the first quantity of tobacco until the upper surface of the resulting column of loose tobacco is just below opening 115, closure 130 of course having been raised to its open position to allow entry of conveyor 111 through opening 115. With the first fill having been completed, conveyor 111 is returned to its home position, FIG. 6A, and member 130 is moved downwardly to its closed position. The combination of the press head and piston rod is now freed for free fall by closing valve 151 and opening valve 153. Since there is only a very small space between the press head and the charger wall and since member 130 now closes opening 115, initial free fall of the press head compresses the air trapped between the press head and the loose tobacco. The surface of the column of loose tobacco promptly compacts to form a seal so that, as free fall of the press head and piston rod occurs, the entire mass of tobacco is compacted downwardly, as seen in FIG. 6A, the press head arrives near the top of the air release sleeve. Ram 104 is now operated in conventional fashion to return the press head to its uppermost position, leaving the charger empty above the now compacted mass of the first fill of tobacco.

Member 130 is again moved upwardly clear of opening 115 and conveyor 111 is now operated to supply to the charger a second fill of tobacco, that tobacco collecting on top of the compacted first fill and constituting a loose uncompacted hole, as seen in FIG. 6B.

During the second fill, air is advantageously continuously withdrawn from the bottom of the charger via duct 121. With the second fill complete, conveyor 111 is again returned to its home position and member 130 is lowered to close opening 115. Valve 151 is now opened, with simultaneous closing of valve 153 and the ram operates conventionally to force press head 105 downwardly through the charger in a powered pressing stroke. As seen in FIG. 6C, this stroke compacts all of the tobacco until both the tobacco of the first fill and the tobacco of the second fill constitute a compressed cake contained by the air release sleeve. The combination of the charger and the air release sleeve is then raised to withdraw the air release sleeve from case 101, leaving the compressed cake of tobacco within the case, which can now be closed. Advantageously, all sequences of the method prior to the powered packing stroke shown in FIG. 6C are now out so that only the air pressure differential generated by free fall of the press head and concurrent withdrawal of the air from the bottom of the charger via duct 121. Thus, in the operation illustrated in FIG. 6A, the press head need not forcibly engage the tobacco.

What is claimed is:

1. In the packing into a case or bale of leaf or stripped tobacco delivered from a redryer, wherein packing is accomplished with a packer having a compression chamber, an upright charger and means for supplying loose redried tobacco to the top of the charger, the method comprising providing a press head which can be moved downwardly and upwardly through the charger and is of such size and shape that, when the press head is within the charger, clearance between the periphery of the head and the wall of the charger is very small;

supplying loose redried tobacco to the charger at the top thereof and allowing the tobacco to fall freely in the charger until a predetermined first quantity of tobacco less than that required for the case or bale has collected in the compression chamber and charger in the form of a loose and substantially uncompacted mass of tobacco;

maintaining the press head within an upper portion of the charger to close the upper portion of the charger against upward escape of air save via the very small space between the periphery of the press head and the charger wall;

establishing a volume of air under positive pressure between the press head and the mass of loose tobacco and, while the volume of air under positive pressure exists above the tobacco, withdrawing air from the bottom of the charger, whereby an air pressure differential is established across the height of the mass of loose tobacco, the air under positive pressure above the tobacco then applying a downward force on the top of the mass of tobacco;

continuing the air pressure differential until the mass of loose tobacco has been downwardly compacted by said downward force to such an extent that the charger will accommodate a second quantity of tobacco;

then supplying a predetermined second quantity of loose redried tobacco to the charger to bring the total quantity of tobacco in the compression chamber and charger to that required for the case or bale; and compressing the total amount of tobacco into the compression chamber by forcing the press head downwardly through the charger to produce a compressed cake of tobacco in which no line of demarcation between the two quantities of tobacco is observable.

2. The method defined by claim 1, wherein the step of withdrawing air from the bottom of the charger is continued during supply of the second quantity of tobacco to the charger.

3. The method defined by claim 2, wherein the step of withdrawing air from the bottom of the charger is continued until the step of compressing the total amount of tobacco into the compression chamber has been completed.

4. The method according to claim 1, wherein the volume of air under pressure is established by delivering air under pressure into the charger via an opening in the charger.

5. The method according to claim 1, wherein the volume of air under pressure is established by high speed lowering of the press head without introduction of air into the charger.

6. The method defined by claim 5, wherein the volume of air under positive pressure is established by free fall of the press head.

7. The method defined by claim 1, wherein the volume of air under positive pressure is established by delivering air under pressure into the charger via an opening in the charger; and the air delivered to the charger is taken from a location in which the ambient air is at a temperature approximating that of the tobacco delivered by the redryer.

8. The method defined by claim 1 and further comprising withdrawing the apress head upwardly through the charger after the total amount of tobacco has been compressed into the compression chamber; and placing the bottom end of the charger in communication with the atmosphere as the upward withdrawal of the press head commences, whereby no significant negative air pressure is generated by upward movement of the press head.

9. In an apparatus for packing leaf or stripped tobacco into a case or bale when the tobacco is supplied from a redryer, the combination of a compression chamber;

an upright charger communicating at its bottom end with the top of the compression chamber, the charger having transverse cross-sectional inner dimensions which are constant throughout the length of the charger;

a vertically acting ram including a power cylinder, a piston rod and a press head secured to the piston rod, the press head being of such transverse shape and dimensions that, when the press head is within the charger, only a very small space exists between the periphery of the press head and the charger wall, the ram being operative to support the press head in an upwardly retracted position within the top of the charger;

means for supplying a first fill of loose tobacco to the charger with the loose tobacco of the first fill extending as a loose and uncompacted mass extending from the bottom of the compression chamber to a point spaced below the press head when the press head is in its upwardly retracted position;

means for establishing a volume of air under positive pressure in the charger between said mass of tobacco and the press head; and means for withdrawing air from the bottom of the charger while said volume of air under positive pressure persists, whereby a pressure differential is established from top to bottom of the mass of tobacco, said pressure differential causing the loose mass of tobacco to be compacted downwardly to make room in the charger for an additional fill of tobacco.

* * * * *